US005514535A

United States Patent [19]

Hamilton et al.

[11] Patent Number: 5,514,535

[45] Date of Patent: May 7, 1996

[54] STABILIZED VINYL SULFONE HARDENING COMPOSITIONS USEFUL IN PHOTOGRAPHIC MANUFACTURING

[75] Inventors: Lewis R. Hamilton, Rochester; Peter A. Marr, Webster; Philip R. Martell; Kristine F. Ohman, both of Rochester, all of N.Y.

[73] Assignee: Eastman Kodak Company, Rochester, N.Y.

[21] Appl. No.: 438,634

[22] Filed: May 10, 1995

[51] Int. Cl.[6] ..... G03C 1/30

[52] U.S. Cl. ..... 430/622; 430/603; 430/621; 430/631; 430/640; 252/182.17; 252/402; 252/405

[58] Field of Search ..... 430/622, 621, 430/631, 603, 640; 252/182.17, 402, 405; 527/203; 568/19

[56] References Cited

U.S. PATENT DOCUMENTS 3,272,631 9/1966 Garrett et al. ..... 430/603
3,490,911 1/1970 Burness et al. .
3,642,486 2/1972 Burness et al. .
3,841,872 10/1974 Burness et al. .
4,104,302 8/1978 Smith et al. ..... 430/621
4,171,976 10/1976 Burness et al. .
4,670,377 6/1987 Miyoshi et al. ..... 430/621

*Primary Examiner*—Thorl Chea
*Attorney, Agent, or Firm*—Alfred P. Lorenzo

[57] ABSTRACT

Hydrophilic colloids, such as gelatin, which are employed in the manufacture of photographic elements are commonly treated with a hardening composition, among the most useful of which are hardening compositions containing vinyl sulfone hardening agents such as bis(vinylsulfonyl)methane. In accordance with this invention, a sulfate, such as sodium sulfate, is utilized as both an effective conductivity marker and an effective inhibitor of homopolymerization in such hardening compositions.

20 Claims, No Drawings

STABILIZED VINYL SULFONE HARDENING COMPOSITIONS USEFUL IN PHOTOGRAPHIC MANUFACTURING

FIELD OF THE INVENTION

This invention relates in general to the hardening of hydrophilic colloids utilized in photographic elements and in particular to the hardening of such colloids using a hardening composition containing, as a hardening agent, a compound comprising two or more vinyl sulfonyl groups. More specifically, this invention relates to improved hardening compositions containing the aforesaid hardening agent and a stabilizing agent which inhibits homopolymerization of such hardening agent.

BACKGROUND OF THE INVENTION

In the photographic arts, hydrophilic colloids, typically refined gelatin, have been used in photographic elements to form layers, such as radiation-sensitive layers (e.g., silver halide emulsion layers), interlayers, subbing layers and overcoat layers. Various addenda are conventionally incorporated in the layers, including addenda to alter the properties of the hydrophilic colloids present therein. It has been recognized previously in the art that without special modifiers, hydrophilic colloids such as gelatin are easily abraded and ingest large quantities of water when brought into contact with aqueous solutions, thereby causing an undesirable amount of swelling. Also, unmodified colloid coatings tend to melt at relatively low temperatures, thereby limiting their temperature range of utility. To obviate these deficiencies, certain addenda generically designated as "hardeners" are incorporated into hydrophilic colloids intended to be used in forming photographic element layers. Both inorganic and organic hardeners are known. A summary of hardeners is presented in *Research Disclosure*, Item 36544, September, 1994. The terms "forehardened" and "forehardener" are employed when the hardener is associated with hydrophilic colloid in the course of manufacturing a photographic element. The terms "prehardened" and "prehardener" are employed when the hardener is associated with a hydrophilic colloid layer of a photographic element in a processing solution preceding the developer bath for the element.

Among hardeners of the active olefin type, a preferred class of hardeners particularly useful as forehardeners are compounds comprising two or more vinyl sulfonyl groups. These compounds are hereinafter referred to as "vinyl sulfones." Compounds of this type are described in numerous patents including, for example, U.S. Pat. Nos. 3,490, 911, 3,642,486, 3,841,872 and 4,171,976. Vinyl sulfone hardeners are believed to be effective as hardeners as a result of their ability to crosslink polymers making up the colloid. One disadvantage that has been observed in using vinyl sulfone hardeners is that these hardeners, particularly the more active ones, such as bis(vinylsulfonyl)methane (BVSM), will homopolymerize. Homopolymerization can occur before the hardeners are associated with the hydrophilic colloid and it can occur as a competing reaction after association. The tendency of the hardeners to homopolymerize is disadvantageous in requiring careful selection of hardener preparation and handling conditions and in causing hardener to become unavailable for the desired crosslinking reaction with the hydrophilic colloid. The consequences of such homopolymerization include the inability to maintain the desired concentration of hardener in the hardening solution and the plugging of delivery lines and other equipment with the polymer that is formed, thereby necessitating frequent downtime for cleaning and maintenance.

The problem of homopolymerization of vinyl sulfones used in compositions for hardening of photographic gelatin has long been recognized in the photographic art. Thus, for example, D. M. Burness et al in U.S. Pat. No. 4,171,976, issued Oct. 23, 1979, describes this problem and discloses the use of certain inhibitors such as 3,5-dinitrobenzoic acid to prevent or minimize homopolymerization of bis(vinylsulfonyl)alkane hardeners. Similarly, Burness et al U.S. Pat. No. 3,841,872, issued Oct. 15, 1974, utilizes hydroquinone as a stabilizer in the preparation of bis(vinylsulfonyl)alkane hardeners.

In the preparation and handling of hardening solutions containing a vinyl sulfone hardening agent, it is advantageous to utilize a conductivity marker, i.e., a material that is added to the relatively non-conductive hardening solution to assist with identification by rendering it feasible to monitor electrical conductivity and thereby ensure delivery of the correct hardener solution to the coating station. Thus, for example, a desirable conductivity for a BVSM solution is 2.6 to 3.0 mhos/cm. The conductivity marker should not adversely affect the quality or handling of the hardening solution.

A compound that has been commonly used as a conductivity marker in photographic hardening compositions is potassium nitrate. However, the use of potassium nitrate is disadvantageous in that it contributes to and accelerates the formation of homopolymer in vinyl sulfone hardening solutions when ferric ion is present in levels of only a few parts per million. Such levels of ferric ion are commonly encountered, with a major source being the iron oxides formed on the surfaces of iron pipes and other equipment used to convey the hardening solution and a minor source being iron present in the vinyl sulfone monomer from its synthesis. Thus, when using potassium nitrate as a conductivity marker, it is difficult to meet required quality specifications and the homopolymerization which occurs results in clogged delivery lines and frequent interruptions in the photographic manufacturing process.

In light of the above, it is apparent that the photographic art is in need of a highly effective stabilizer for vinyl sulfone hardening compositions that is of low cost, free from adverse sensitometric effects, highly effective in inhibiting homopolymerization in the presence of ferric ion and useful as a conductivity marker. It is toward the objective of providing such new and improved stabilizer that the present invention is directed.

SUMMARY OF THE INVENTION

In accordance with this invention, it has been discovered that sulfates are both an effective conductivity marker and an effective inhibitor of homopolymerization in vinyl sulfone hardening compositions. Useful sulfates for this purpose include ammonium sulfate, alkali metal sulfates such as lithium, sodium or potassium sulfate, and alkaline earth metal sulfates such as magnesium sulfate. The use of alkali metal sulfates is preferred and the use of sodium sulfate is particularly preferred.

In the practice of this invention, vinyl sulfone hardeners are inhibited against homopolymerization without interfering with their utility as hardeners, i.e., hydrophilic colloid crosslinking agents, by combining with the hardener a homopolymerization-inhibiting amount of a sulfate.

In one embodiment, this invention is directed to a photographic hardener composition comprising a vinyl sulfone hardener and an amount sufficient to inhibit homopolymerization of the hardener of a sulfate.

In another embodiment, this invention is directed to an aqueous coating composition useful as a layer of a photographic element comprising a hydrophilic colloid at least partially forehardened with a vinyl sulfone hardener. The composition comprises a sulfate in an amount sufficient to inhibit homopolymerization of the hardener.

In still another embodiment, this invention is directed to a process of hardening an aqueous coating composition useful as a layer of a photographic element comprising adding a vinyl sulfone hardener to a hydrophilic colloid. The improvement comprises inhibiting homopolymerization of the hardener with a sulfate.

In yet another embodiment, this invention is directed to a process of hardening a hydrophilic colloid-containing layer of a photographic element by adding a vinyl sulfone hardener to a coating composition containing the hydrophilic colloid and coating the composition onto a photographic support. The improvement comprises inhibiting homopolymerization of the hardener with a sulfate.

In an additional embodiment, this invention is directed to a photographic element comprising a support and, coated on the support, one or more layers, at least one of which is radiation-sensitive, containing a hydrophilic colloid at least partially forehardened with a vinyl sulfone hardener. The improvement comprises a sulfate present with the hardener in an amount sufficient to inhibit homopolymerization of the hardener.

In the foregoing embodiments, the vinyl sulfone hardener is preferably of the formula:

$$(H_2C{=}CH{-}SO_2)_n{-}Z$$

wherein n is an integer with a value of 2 to 6 and Z is an organic linking group with a valence equal to n.

DETAILED DESCRIPTION OF THE INVENTION

Any hydrophilic colloid which can be hardened by a vinyl sulfone hardening agent can be employed in the practice of this invention.

The use of film-forming hydrophilic colloids in photographic elements, including photographic films and photographic papers, is very well known. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion-layer having associated therewith a cyan image dye-providing material, the element containing in at least one layer thereof a hydrophilic colloid that has been hardened with a hardening composition containing a vinyl sulfone hardening agent and a stabilizing amount of a sulfate that inhibits homopolymerization of the vinyl sulfone hardening agent.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Any of the vinyl sulfone hardeners known to the art can be utilized in the practice of this invention. As hereinabove described, a preferred class of vinyl sulfone hardeners for use in this invention are compounds of the formula:

$$(H_2C{=}CH{-}SO_2)_n{-}Z$$

wherein n is an integer with a value of 2 to 6 and Z is an organic linking group with a valence equal to n. Suitable examples of the organic linking group represented by Z include alkyl, alkylene, aryl, arylene, aralkyl and alkaryl groups. As a further example Z can be a heteroatom such as a nitrogen atom or an ether oxygen atom.

In the above formula Z is preferably $$-A-$$

$$-O-A-O-,$$

or $$-D-$$

where A is an alkylene group containing 1 to 8 carbon atoms which may be unsubstituted or substituted and the alkylene chain may be interrupted by one or more hetero atoms or organic groups, or an arylene group, which may be substituted or unsubstituted, and D is a trivalent alkylene group, a trivalent arylene group which may be substituted with one or more additional $CH_2{=}CH{-}SO_2{-}$ groups, a trivalent cyclic alkylene group which may be substituted with one or more $CH_2{=}CH{-}SO_2{-}$groups, or a trivalent heterocyclic group which may be substituted with one or more $CH_2{=}CH{-}SO_2{-}$ groups. Preferred substituents for A include —OH, phenyl, aralkyl, such as phenethyl, or $CH_2{=}CH{-}SO_2{-}$ groups. The aryl moiety of the aralkyl group may be sulfonated. The alkylene group may be interrupted by one or more of the following: oxygen atoms, arylene groups, cycloalkyl groups, —NHCONH—, or —N—R, where R is an alkyl group containing 1 to 8 carbon atoms.

A particularly preferred class of vinyl sulfone hardeners for use in this invention are bis(vinylsulfonyl)alkane hardeners of the formula:

$$CH_2{=}CH{-}SO_2{-}(CH_2)_x{-}SO_2{-}CH{=}CH_2$$

where x is an integer with a value of from 1 to 3.

A preferred vinyl sulfone hardener for use in this invention is bis(vinylsulfonyl)methane (BVSM) which has the formula:

$$CH_2{=}CH{-}SO_2{-}CH_2{-}SO_2{-}CH{=}CH_2$$

Another preferred vinyl sulfone hardener for use in this invention is bis(vinylsulfonylmethyl)ether (BVSME) which has the formula:

$$CH_2{=}CH{-}SO_2{-}CH_2{-}O{-}CH_2{-}SO_2{-}CH{=}CH_2$$

Specific examples of other vinyl sulfone hardening agents that are useful in this invention include the following:

$$CH_2{=}CHSO_2CH_2CH_2SO_2CH{=}CH_2$$

$$CH_2{=}CHSO_2(CH_2)_5SO_2CH{=}CH_2$$

$$CH_2{=}CHSO_2OCH_2OSO_2CH{=}CH_2$$

$$CH_2{=}CHSO_2CH_2CH_2OCH_2CH_2NHCONHCH_2CH_2{-}OCH_2CH_2SO_2CH{=}CH_2$$

$$CH_2{=}CHSO_2CH_2CH_2OCH_2CH_2OCH_2CH_2SO_2CH{=}CH_2$$

$$CH_2{=}CHSO_2CH_2CH_2OCH_2CH_2CH_2CH_2OCH_2CH_2SO_2CH{=}CH_2$$

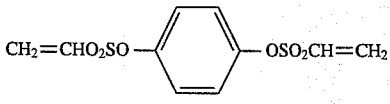

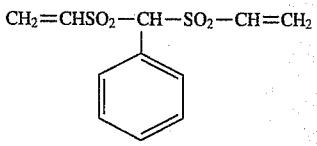

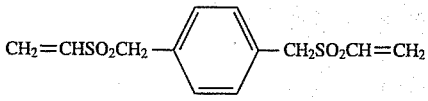

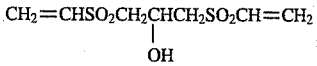

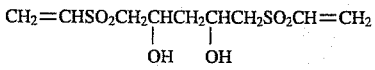

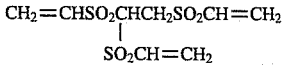

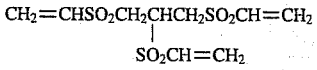

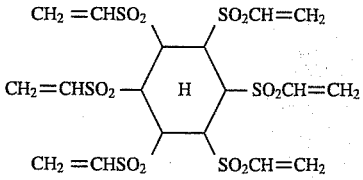

To be effective in inhibiting homopolymerization of the vinyl sulfone hardener, the sulfate is associated with the hardener while all or a portion of the hardener remains in its unreacted monomeric form. The sulfate and the hardener can be brought together in any convenient manner. For example, the sulfate can be blended with the hydrophilic colloid to be hardened so that upon addition of the hardener the sulfate is already present. It is generally preferred that the sulfate be blended with the hardener before the hardener is blended with the hydrophilic colloid.

The vinyl sulfone hardeners described herein can be used in any effective amount in hardening hydrophilic colloids. Suitable amounts are typically in the range of from about 0.5 to about 10 percent by weight, based on the weight of hydrophilic colloid, and more preferably in the amount of from about 1 to about 3 percent by weight.

The sulfate can be used as a conductivity marker and homopolymerization inhibitor over a wide range of concentrations. Suitable concentrations of the sulfate are typically in the range of from about 0.05 to about 0.6 moles per mole of vinyl sulfone hardening agent, and more preferably in the range of from about 0.1 to about 0.4 moles per mole of vinyl sulfone hardening agent. The time required for polymer to form in the hardening composition increases with increase in the molar ratio of sulfate to vinyl sulfone.

The use of the sulfate as a conductivity marker is for the purpose of facilitating identification of the hardening solution. Electrical conductivity is much easier to monitor than other characteristics of such solutions and by using the sulfate in an appropriate concentration, a desired level of electrical conductivity can be readily established.

Vinyl sulfones are usually prepared from the corresponding haloethylsulfonyl compounds by dehydrohalogenation using a strong organic base such as triethylamine. One of the problems involved in synthesizing such compounds, particularly the more active ones, such as BVSM, is that they tend to homopolymerize in the presence of the strong base. This problem can be alleviated by combining the sulfate with the haloethylsulfonyl precursor compound. In this way, the sulfate stabilizing agent is associated with the vinyl sulfone hardener from its inception.

An important feature of the present invention is the ability of the sulfate to protect against homopolymerization in the presence of trace amounts of ferric ion, e.g., 2 to 20 ppm. It is extremely difficult to avoid such levels of iron in production equipment and the invention makes it unnecessary to take special precautions to reduce iron levels. It is believed that the sulfate may interact with ferric ion and effectively "remove" it from the solution and thereby help to inhibit or delay homopolymerization of the vinyl sulfone.

Vinyl sulfones are believed to be able to undergo homopolymerization through a number of different mechanisms, e.g., radical ion (ether cationic or anionic) as well as base-catalyzed polymerization, with the tendency for homopolymerization to occur being in part dependent on the synthesis procedure. The polymer formed can be of high molecular weight and can also be highly crosslinked. In vinyl sulfone hardening solutions which are particularly prone to undergo homopolymerization, a heavy precipitate will settle out quite quickly, for example within a few hours. The extent of precipitation is affected by a number of factors such as, for example, the pH of the composition.

It should be noted that the sulfate can interact with ferric ion to form a yellow-colored precipitate composed, at least in part, of $Fe_3O_4$ and FeO(OH). However, the amount of such precipitate which is formed is slight and it does not present problems of plugging of delivery lines and other equipment to anywhere near the extent that can result from the homopolymerization of the vinyl sulfone hardener.

The invention is further illustrated by the following examples of its practice.

EXAMPLES 1 to 5

Aqueous solutions of BVSM were prepared in which various concentrations of ferric ion ($Fe^{+3}$) and sodium sulfate ($Na_2SO_4$) were incorporated in order to determine the effects of these agents on the tendency of BVSM to undergo homopolymerization. The concentration of BVSM in each solution was 0.92 moles/liter. Initially, all solutions were clear. They were maintained at room temperature and inspected for polymer formation after three days of storage and again after two weeks of storage. Ferric ion concentrations ranging from zero to 20 ppm, based on total solution, were evaluated. The effect of sodium sulfate was evaluated at concentrations of zero, 0.1 moles per mole of BVSM, 0.2 moles per mole of BVSM and 0.4 moles per mole of BVSM. The solutions were rated as "CL" meaning clear, i.e., no observable precipitate; "CL*" meaning a very slight amount of a yellow precipitate attributable to the interaction of ferric ion with $Na_2SO_4$ rather than the homopolymerization of BVSM; "SP" meaning slight precipitate; "MP" meaning moderate precipitate; "HP" meaning heavy precipitate; "CL" meaning variable results from batch to batch ranging from clear to moderate precipitate; and "CL*" meaning variable results from batch to batch ranging from clear to heavy precipitate. The results obtained are summarized in Table I below.

TABLE I

| | $Fe^{+3}$ Concentration | Appearance After Three Days Concentration of $Na_2SO_4$ | | | | Appearance After Two Weeks Concentration of $Na_2SO_4$ | | | |
|---|---|---|---|---|---|---|---|---|---|
| Example No. | (ppm) | 0 | 0.1 | 0.2 | 0.4 | 0 | 0.1 | 0.2 | 0.4 |
| 1 | 0 | SP | CL | CL* | CL* | SP | CL | CL* | Cl* |
| 2 | 2 | MP | CL | CL* | CL* | HP | CL | CL* | CL* |
| 3 | 5 | HP | CL | CL* | CL* | HP | CL | CL* | CL* |
| 4 | 10 | HP | CL | CL* | CL* | HP | CL** | CL* | CL* |
| 5 | 20 | HP | HP | CL* | CL* | HP | CL*** | CL*** | CL* |

As shown by the test results which are summarized in Table I, polymer is precipitated in all solutions which did not include $Na_2SO_4$ with increasing amounts of polymer being formed at higher levels of ferric ion concentration and at prolonged periods of storage. Use of $Na_2SO_4$ at an effective concentration is seen to reduce or even eliminate polymer formation even at high levels of ferric ion concentration and prolonged periods of storage.

The tests described above were repeated using lithium sulfate, potassium sulfate, ammonium sulfate and magnesium sulfate in place of sodium sulfate and substantially the same results were obtained in each instance.

The insoluble and intractable polymers formed as a result of homopolymerization of vinyl sulfone hardener solutions in manufacturing delivery lines are known to induce liquid flow disruptions or flow discontinuities during the coating of photographic products. The flow disruption arises due to partial occlusion of the delivery lines (control valves, strainers and/or pumps), while the flow discontinuities are caused by total occlusion of the delivery lines or delivery line components. This has been a major problem which has long plagued the photographic manufacturing process and solutions to the problem proposed heretofore have been generally ineffective. Thus, for example, while the nitro-substituted aromatic compounds of U.S. Pat. No. 4,171,976 provide effective protection in the synthesis stage of vinyl sulfone manufacture and use they are not as effective as desired in the stages involved in preparation and coating of gelatin or other hydrophilic colloid compositions.

The sulfates have been found to be surprisingly effective as stabilizers which prevent homopolymerization of vinyl sulfone hardeners. By their use, the concentration of vinyl sulfone hardener in solution does not significantly change from the point of manufacture to the point of use. Stringent specifications can thus be maintained for solution concentration. The integrity of the delivery system is not compromised due to plugging by polymer and the burdens of maintenance and cleaning are greatly reduced. The sulfates have the further advantage of also serving as effective conductivity markers.

The invention has been described in detail, with particular reference to certain preferred embodiments thereof, but it should be understood that variations and modifications can be effected within the spirit and scope of the invention.

We claim:

1. A hardening composition that is useful in hardening a hydrophilic colloid which is incorporated in a layer of a photographic element, said hardening composition comprising a vinyl sulfone hardening agent and a sufficient amount of a sulfate to inhibit homopolymerization of said vinyl sulfone hardening agent; said sulfate being selected from the group consisting of ammonium sulfate, alkali metal sulfates and alkaline earth metal sulfates.

2. A hardening composition as claimed in claim 1, wherein said vinyl sulfone hardening agent is represented by the formula:

$$(H_2C{=}CH{-}SO_2)_n{-}Z$$

wherein n is an integer with a value of 2 to 6 and Z is an organic linking group with a valence equal to n.

3. A hardening composition as claimed in claim 2, wherein Z is a heteroatom or an alkyl, alkylene, aryl, arylene, aralkyl or alkaryl group.

4. A hardening composition as claimed in claim 1, wherein said vinyl sulfone hardening agent is represented by the formula:

$$CH_2{=}CH{-}SO_2{-}(CH_2)_x{-}SO_2{-}CH{=}CH_2$$

wherein x is an integer with a value of from 1 to 3.

5. A hardening composition as claimed in claim 1, wherein said vinyl sulfone hardening agent is bis (vinylsulfonyl) methane.

6. A hardening composition as claimed in claim 1, wherein said vinyl sulfone hardening agent is bis(vinylsulfonylmethyl)ether.

7. A hardening composition as claimed in claim 1, wherein said sulfate is an alkali metal sulfate.

8. A hardening composition as claimed in claim 1, wherein said sulfate is sodium sulfate.

9. A hardening composition as claimed in claim 1, wherein said sulfate is present therein in an amount of from about 0.05 to about 0.6 moles per mole of vinyl sulfone hardening agent.

10. A hardening composition as claimed in claim 1, wherein said sulfate is present therein in an amount of from about 0.1 to about 0.4 moles per mole of vinyl sulfone hardening agent.

11. An aqueous coating composition that is useful in the preparation of a photographic element; said coating composition comprising a hydrophilic colloid, a sufficient amount of a vinyl sulfone hardening agent to harden said hydrophilic colloid, and a sufficient amount of a sulfate to inhibit homopolymerization of said vinyl sulfone hardening agent; said sulfate being selected from the group consisting of ammonium sulfate, alkali metal sulfates and alkaline earth metal sulfates.

12. An aqueous coating composition as claimed in claim 11, wherein said hydrophilic colloid is gelatin.

13. An aqueous coating composition as claimed in claim 11, wherein said vinyl sulfone hardening agent is present therein in an amount of from about 0.5 to about 10 percent by weight based on the weight of said hydrophilic colloid and said sulfate is present therein in an amount of from about 0.05 to about 0.6 moles per mole of vinyl sulfone hardening agent.

14. An aqueous coating composition as claimed in claim 11, wherein said vinyl sulfone hardening agent is bis(vinylsulfonyl)methane and said sulfate is sodium sulfate.

15. In a process of hardening an aqueous coating composition that is useful in forming a layer of a photographic element comprising the step of adding a vinyl sulfone hardening agent to a hydrophilic colloid, the improvement comprising inhibiting homopolymerization of said vinyl sulfone hardening agent by combining it with an effective amount of a sulfate selected from the group consisting of ammonium sulfate, alkali metal sulfates and alkaline earth metal sulfates.

16. A process as claimed in claim 15, wherein said hydrophilic colloid is gelatin, said vinyl sulfone hardening agent is bis(vinylsulfonyl)methane and said sulfate is sodium sulfate.

17. In a process for the manufacture of a photographic element comprising the step of adding a vinyl sulfone hardening agent to a coating composition containing a hydrophilic colloid and coating said composition on a photographic support, the improvement comprising inhibiting homopolymerization of said vinyl sulfone hardening agent by combining it with an effective amount of a sulfate selected from the group consisting of ammonium sulfate, alkali metal sulfates and alkaline earth metal sulfates.

18. A process as claimed in claim 17, wherein said hydrophilic colloid is gelatin, said vinyl sulfone hardening agent is bis(vinylsulfonyl)methane and said sulfate is sodium sulfate.

19. In a photographic element comprising a support having one or more layers coated thereon at least one of which is radiation-sensitive and at least one of which contains a hydrophilic colloid at least partially forehardened with a vinyl sulfone hardening agent, the improvement wherein said at least one layer containing said vinyl sulfone hardening agent also contains a sulfate in an amount sufficient to inhibit homopolymerization of said vinyl sulfone hardening agent; said sulfate being selected from the group consisting of ammonium sulfate, alkali metal sulfates and alkaline earth metal sulfates.

20. A photographic element as claimed in claim 19, wherein said hydrophilic colloid is gelatin, said vinyl sulfone hardening agent is bis(vinylsulfonyl) methane and said sulfate is sodium sulfate.

* * * * *